US009322611B1

(12) United States Patent
Barfoot et al.

(10) Patent No.: US 9,322,611 B1
(45) Date of Patent: Apr. 26, 2016

(54) MODULAR STOCK FOR A FIREARM

(71) Applicant: Magpul Industries Corp., Boulder, CO (US)

(72) Inventors: Grady E. Barfoot, Denver, CO (US); Turner Sessions, Lafayette, CO (US)

(73) Assignee: MAGPUL INDUSTRIES CORP., Louisville, CO (US)

( * ) Notice: Subject to any disclaimer, the term of this patent is extended or adjusted under 35 U.S.C. 154(b) by 0 days.

(21) Appl. No.: 14/664,229

(22) Filed: Mar. 20, 2015

(51) Int. Cl.

| | |
|---|---|
| ***F41C 23/00*** | (2006.01) |
| ***F41C 23/16*** | (2006.01) |
| ***F41C 23/20*** | (2006.01) |
| ***F41C 27/00*** | (2006.01) |

(52) U.S. Cl.
CPC ..... *F41C 23/16* (2013.01); *F41C 23/20* (2013.01); *F41C 27/00* (2013.01)

(58) Field of Classification Search
USPC ..... 42/71.01, 73, 75.01, 72, 77
See application file for complete search history.

(56) References Cited

U.S. PATENT DOCUMENTS

| | | | | |
|---|---|---|---|---|
| 1,760,731 | A | 5/1930 | Williams | |
| 2,529,733 | A | 11/1950 | King | |
| 3,611,611 | A | 10/1971 | Quinney | |
| 3,842,527 | A | 10/1974 | Low | |
| 4,220,071 | A | 9/1980 | Seiderman | |
| 4,297,801 | A | 11/1981 | Kahn | |
| 4,519,156 | A | 5/1985 | Shaw | |
| 4,608,909 | A | 9/1986 | Peters | |
| 4,989,359 | A | 2/1991 | Kinkner et al. | |
| 5,228,887 | A | 7/1993 | Mayer | |
| 5,410,834 | A | 5/1995 | Benton et al. | |
| 5,544,564 | A | 8/1996 | Balbo et al. | |
| 5,678,343 | A | 10/1997 | Menges et al. | |
| 5,706,599 | A | 1/1998 | Knight | |
| 5,987,797 | A | 11/1999 | Dustin | |
| 6,205,696 | B1 | 3/2001 | Bilgeri | |
| 6,301,817 | B1 * | 10/2001 | Hogue | F41C 23/18 42/71.01 |
| 6,427,372 | B1 | 8/2002 | Howard et al. | |
| 6,637,142 | B1 | 10/2003 | Reynolds | |
| 7,104,000 | B2 | 9/2006 | Orth | |
| 7,137,219 | B2 | 11/2006 | Wossner et al. | |
| 7,451,564 | B2 | 11/2008 | Wait | |
| 7,523,579 | B2 | 4/2009 | Al-Mulla | |
| 7,587,853 | B2 | 9/2009 | Aalto | |
| 7,631,453 | B2 | 12/2009 | Longueira | |
| 7,823,314 | B1 | 11/2010 | Wheatley | |
| 7,841,121 | B1 | 11/2010 | Barrett | |
| 8,056,278 | B2 | 11/2011 | Bentley | |
| 8,079,169 | B2 | 12/2011 | Gregg | |

(Continued)

OTHER PUBLICATIONS

TacStar, "TacStar Ruger 10-22 Adaptive Tactical Stock", Webpage found at www.tacstar.com/home/tacticalstock.php Inventor(s) aware of prior art on or before Jul. 6, 2015, pp. 3 Published in: US.

*Primary Examiner* — J. Woodrow Eldred
(74) *Attorney, Agent, or Firm* — Neugeboren O'Dowd PC

(57) ABSTRACT

This disclosure describes systems, methods, and apparatus for a selectable barrel support that can be inserted into a forend of a firearm stock to support a first barrel type and flipped, rotated, or otherwise moved to support a second barrel type (or third or fourth barrel types). Bull and tapered barrels are examples of two barrel types that the selectable barrel support can be used to support. The selectable barrel support enables a firearm owner or gunsmith to exchange barrel types on a firearm without having to switch out the firearm stock.

30 Claims, 15 Drawing Sheets

(56) References Cited

U.S. PATENT DOCUMENTS

| | | | |
|---|---|---|---|
| 8,220,194 | B2 | 7/2012 | Crow |
| 8,230,632 | B2 | 7/2012 | Moretti |
| 8,234,808 | B2 | 8/2012 | Lewis et al. |
| 8,341,863 | B2 | 1/2013 | Kefer |
| 8,397,415 | B2 | 3/2013 | Laney et al. |
| 8,397,416 | B2 | 3/2013 | Laney et al. |
| 8,522,468 | B2 | 9/2013 | Webber et al. |
| 8,539,708 | B2 | 9/2013 | Kenney et al. |
| 8,713,838 | B2 | 5/2014 | Ubl et al. |
| 8,782,940 | B1 | 7/2014 | Morris |
| 8,782,943 | B2 | 7/2014 | Jarboe |
| 8,806,789 | B2 | 8/2014 | Devine |
| 2006/0162217 | A1 | 7/2006 | Longueira |
| 2014/0026460 | A1 | 1/2014 | Warburton et al. |
| 2014/0190057 | A1 | 7/2014 | Simpson |

* cited by examiner

MODULAR STOCK FOR A FIREARM

FIELD OF THE INVENTION

The present invention relates to firearms. In particular, but not by way of limitation, the present invention relates to systems and methods for firearm stocks.

BACKGROUND OF THE INVENTION

Rifles often can be fitted with two primary types of barrels: tapered or bull barrels (also known as target barrels or heavy barrels). The bull or target barrel typically has a non-tapered or cylindrical shape, whereas a tapered barrel (typically affixed to most firearms) is tapered toward the muzzle such that the diameter at the muzzle is less than a diameter at the receiver. The non-tapered nature of bull barrels means that they are steadier due to greater weight, less prone to vibration due to their geometry, and can absorb more thermal energy due to their greater mass of metal (and hence are less prone to warping under repeated firing), and are therefore preferred in some applications. Most firearm stocks are shaped to support either of these barrel types, but not both. This means that users who wish to switch barrel types must buy and install an entirely new stock when installing a new barrel. U.S. Pat. No. 8,056,278 provides one solution to this problem in the form of a stock that supports a bull barrel and an insert that can be fitted into the stock to support a tapered barrel. Thus, the '278 patent enables a change in barrel types without the purchase and installation of an entirely new barrel. However, this design suffers from the need to store and keep track of the insert when the stock is used with a bull barrel and hence without the insert.

One application where the switching of barrels occurs is the RUGER 10/22, a widespread .22 caliber rifle platform. The RUGER 10/22 includes a safety pin that is perpendicular to the barrel and arranged on the top front portion of the trigger guard just below the stock. When the trigger guard is inserted into the stock the safety pin must clear an opening in the bottom of the stock shaped to pass the trigger guard. However, the safety pin will impinge one or another side of this opening unless the safety pin is 'centered' in the trigger guard such that neither end of the safety pin extends beyond the sides of the trigger guard.

SUMMARY OF THE DISCLOSURE

Exemplary embodiments of the present invention that are shown in the drawings are summarized below. These and other embodiments are more fully described in the Detailed Description section. It is to be understood, however, that there is no intention to limit the invention to the forms described in this Summary of the Invention or in the Detailed Description. One skilled in the art can recognize that there are numerous modifications, equivalents and alternative constructions that fall within the spirit and scope of the invention as expressed in the claims.

Some embodiments of the disclosure may be characterized as a selectable barrel support of a firearm stock. The selectable barrel support can include an elongate frame and first and second concave barrel recesses. The elongate frame can have a longitudinal axis configured to be parallel to a longitudinal axis of the firearm stock, the elongate frame can have a greater longitudinal dimension than a lateral dimension. The first concave barrel recess can have radii at fore and aft portions of the first concave barrel recess shaped to support a first barrel type. The second concave barrel recess can have a radii at fore and aft portions of the second concave barrel recess shaped to support a second barrel. The first and second concave barrel recesses can be arranged on two separate sides of the elongate frame. One of the first and second concave barrel recesses can be configured to face upward toward a bottom of a barrel of the firearm when the selectable barrel support is engaged in the forend of the firearm stock.

Other embodiments of the disclosure may also be characterized as a firearm stock. The firearm stock can include a forend, a buttstock, and a selectable barrel support. The forend can include a recess formed from first and second inner sides of the forend and an inside bottom of the forend. The buttstock can be coupled to the forend. The selectable barrel support can include an elongate frame, first and second sides, and first and second concave barrel recesses. The elongate frame can have a longitudinal dimension configured to be parallel to a longitudinal axis of the forend. The first and second sides can be shaped to interface with the first and second dinner sides of the forend. The first concave barrel recess can have a radius at a fore portion of the concave barrel recess that is equal to or greater than a radius at an aft portion of the concave barrel recess. The second concave barrel recess can have a greater radius at an aft portion of the second concave barrel recess than at a fore portion of the second concave barrel recess. The first and second concave barrel recesses can be on opposite sides of the elongate frame. One of the first and second concave barrel recesses can be configured to face upward toward a bottom of a barrel of the firearm when the selectable barrel support is engaged in the forend of the firearm stock Other embodiments of the disclosure can be characterized as a method of attaching a reversible barrel support to a firearm stock. The method can include removing a reversible barrel support from a recess in a forend of a firearm stock, wherein the reversible barrel support has a first concave barrel recess facing upward. The method can further include rotating the reversible barrel support over such that a second concave barrel recess of the reversible barrel support faces upward. The method can yet further include inserting the reversible barrel support back into the recess in the forend.

BRIEF DESCRIPTION OF THE DRAWINGS

Various objects and advantages and a more complete understanding of the present invention are apparent and more readily appreciated by referring to the following detailed description and to the appended claims when taken in conjunction with the accompanying drawings:

DETAILED DESCRIPTION

This disclosure discusses a firearm stock including at least a selectable barrel support insert shaped to support at least two different barrel types or shapes, for instance either a tapered or bull barrel. In a particular embodiment, this discussion enables a bull barrel or barrel tapered toward a front of the barrel to be used in a firearm stock without requiring a change of the firearm stock.

Figure 1:
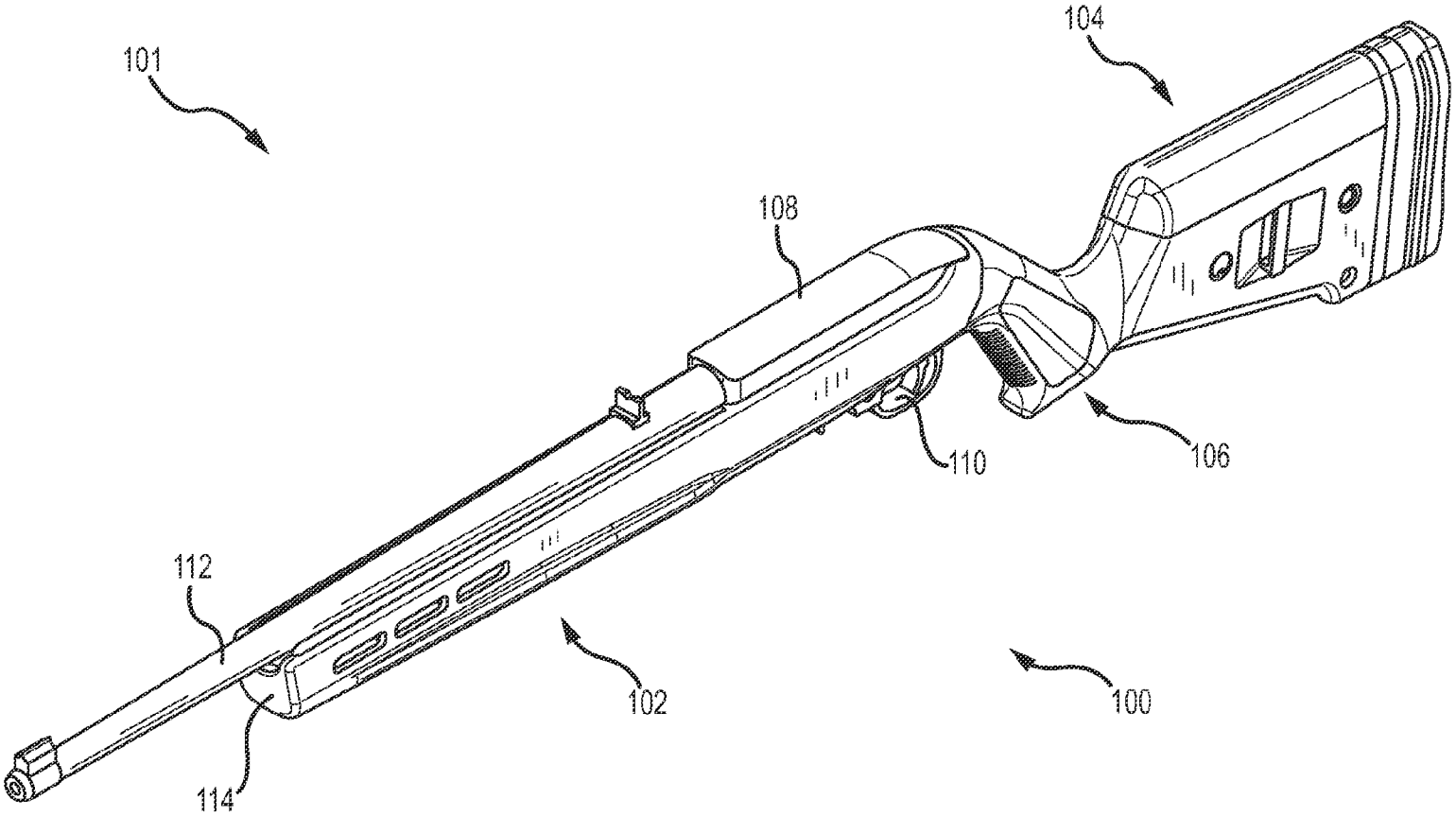
FIG. 1 shows a firearm stock including a selectable barrel support implemented in a complete firearm.
Figure 2:
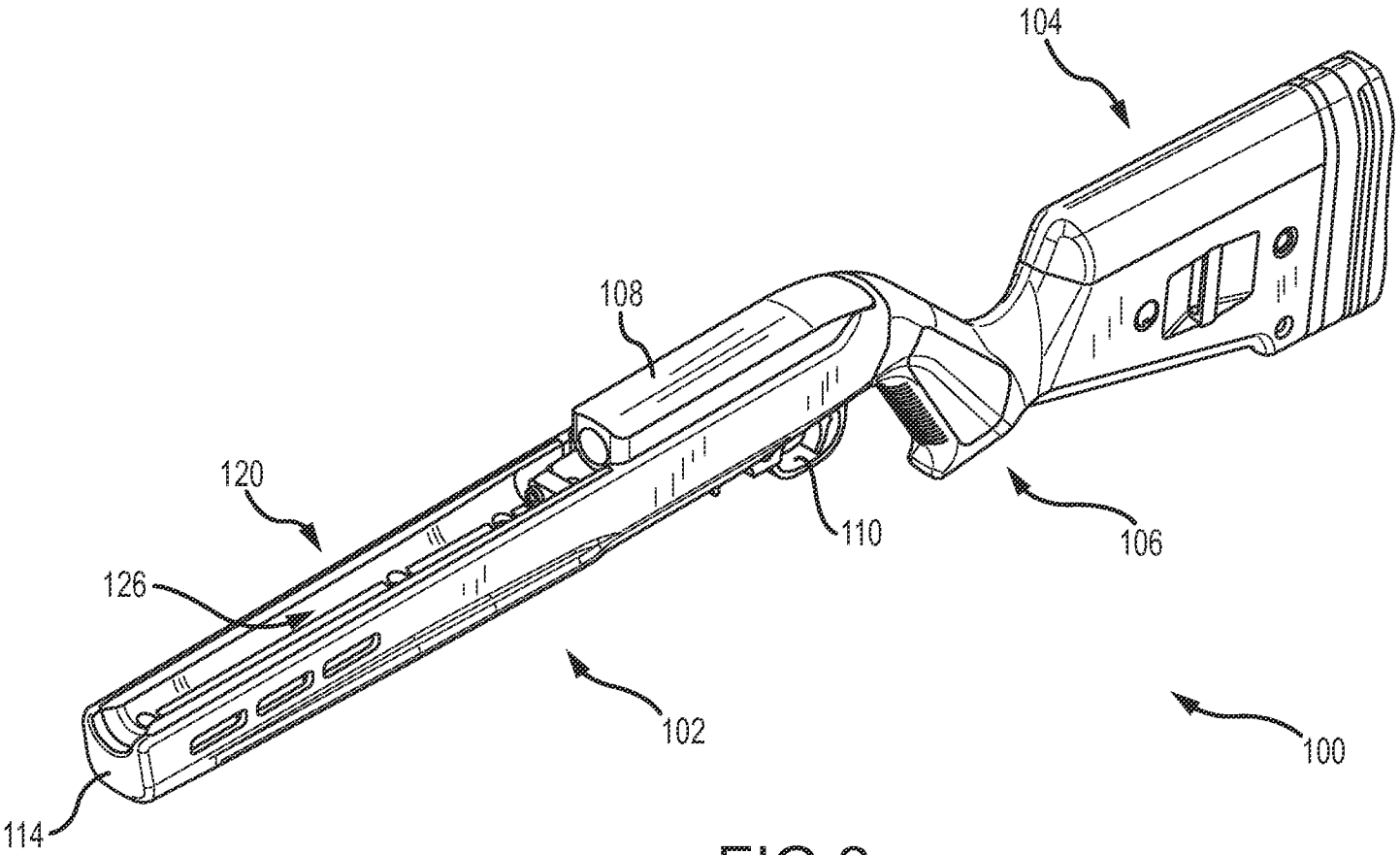
FIG. 2 shows another view of the stock of FIG. 1.
Figure 3:
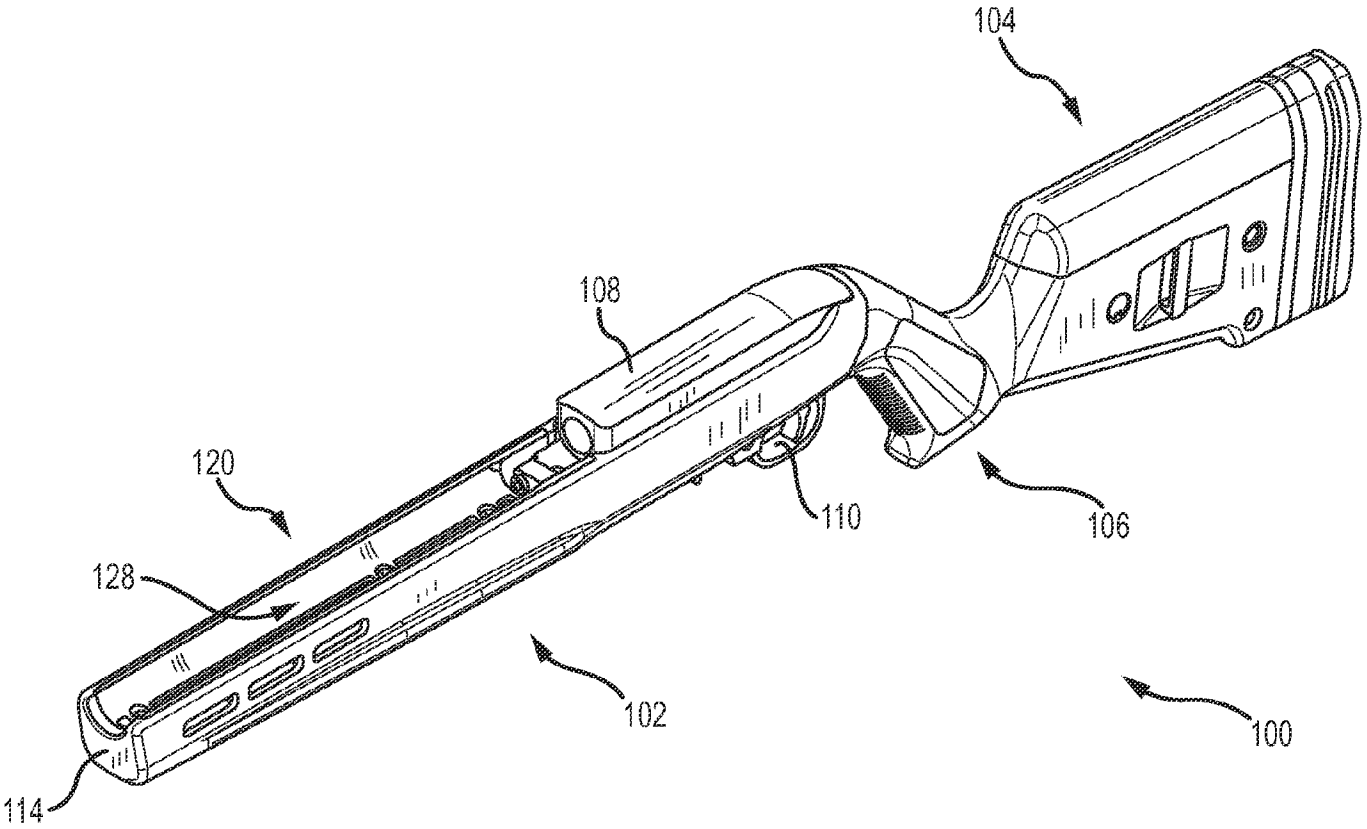
FIG. 3 shows yet another view of the stock of FIG. 1.
Figure 4:
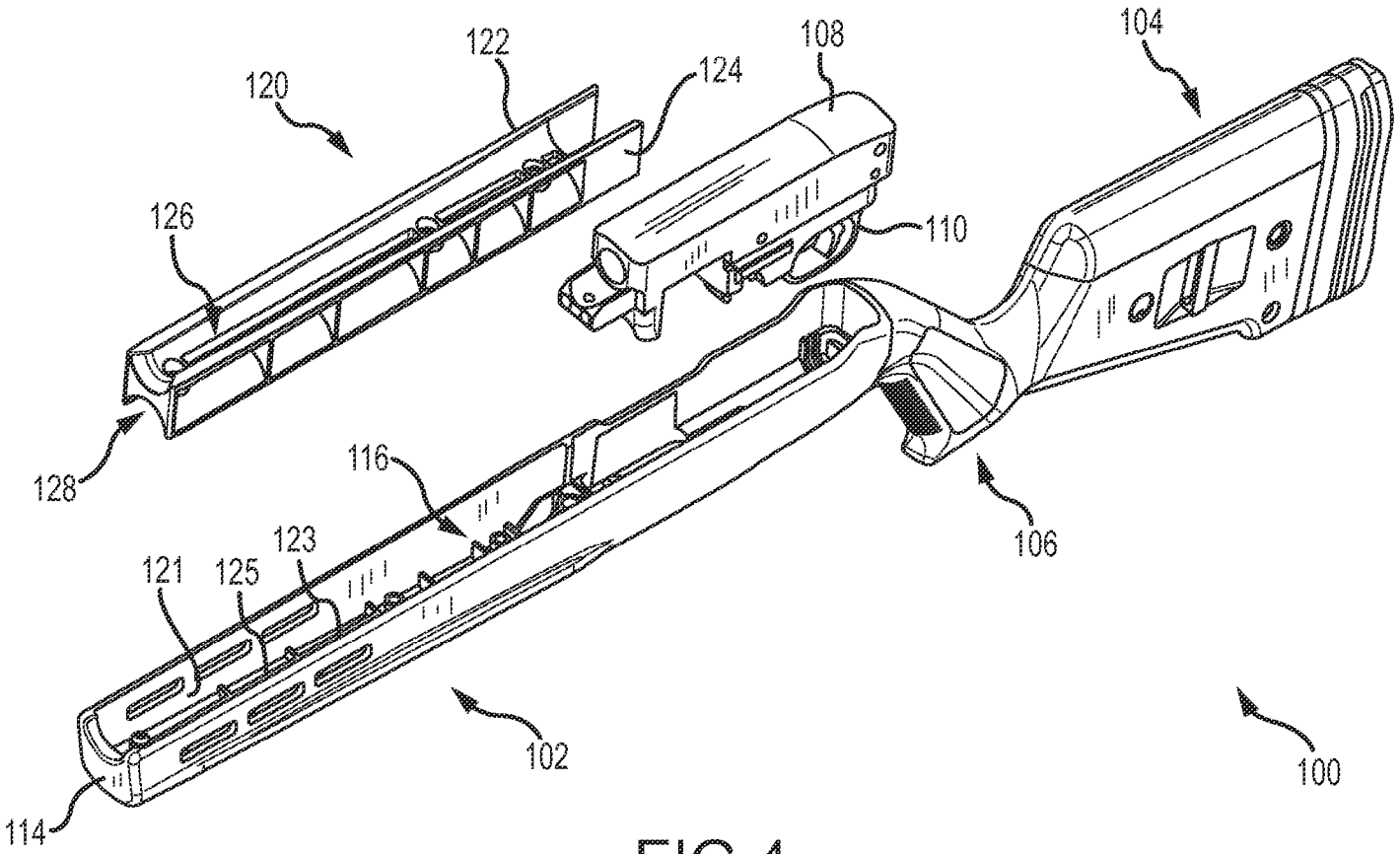
FIG. 4 shows an exploded view of the stock of FIG. 1.

FIGS. 1-4 illustrate different views of an embodiment of a firearm stock and selectable barrel support according to one embodiment of this disclosure. The selectable barrel support can be reversible, and therefore a selectable barrel support includes at least a reversible barrel support. FIG. 1 shows the firearm stock 100 including the selectable barrel support 120 (see FIGS. 2-4) implemented in a complete firearm 101. The stock 100 can include a forend 102 and a buttstock 104 coupled to each other, or further including a grip section 106 coupled between the forend 102 and the buttstock 104. In some embodiments, these two or three components can be modular and detachable. Modular means that a firearm user or a firearm manufacturer can combine any two modular parts to form a functional assembly. For instance, different forends 102 can be combined with different buttstocks 104 or different grip sections 106. In this way, the stock 100 can be manufactured in polymer at far less cost than if the whole stock 100 were manufactured as a single component.

The firearm 101 having the stock 100 can further include a receiver 108, a trigger assembly 110, and a barrel 112 coupled to the receiver 108. The barrel can rest on the selectable barrel support 120.

Figure 5:
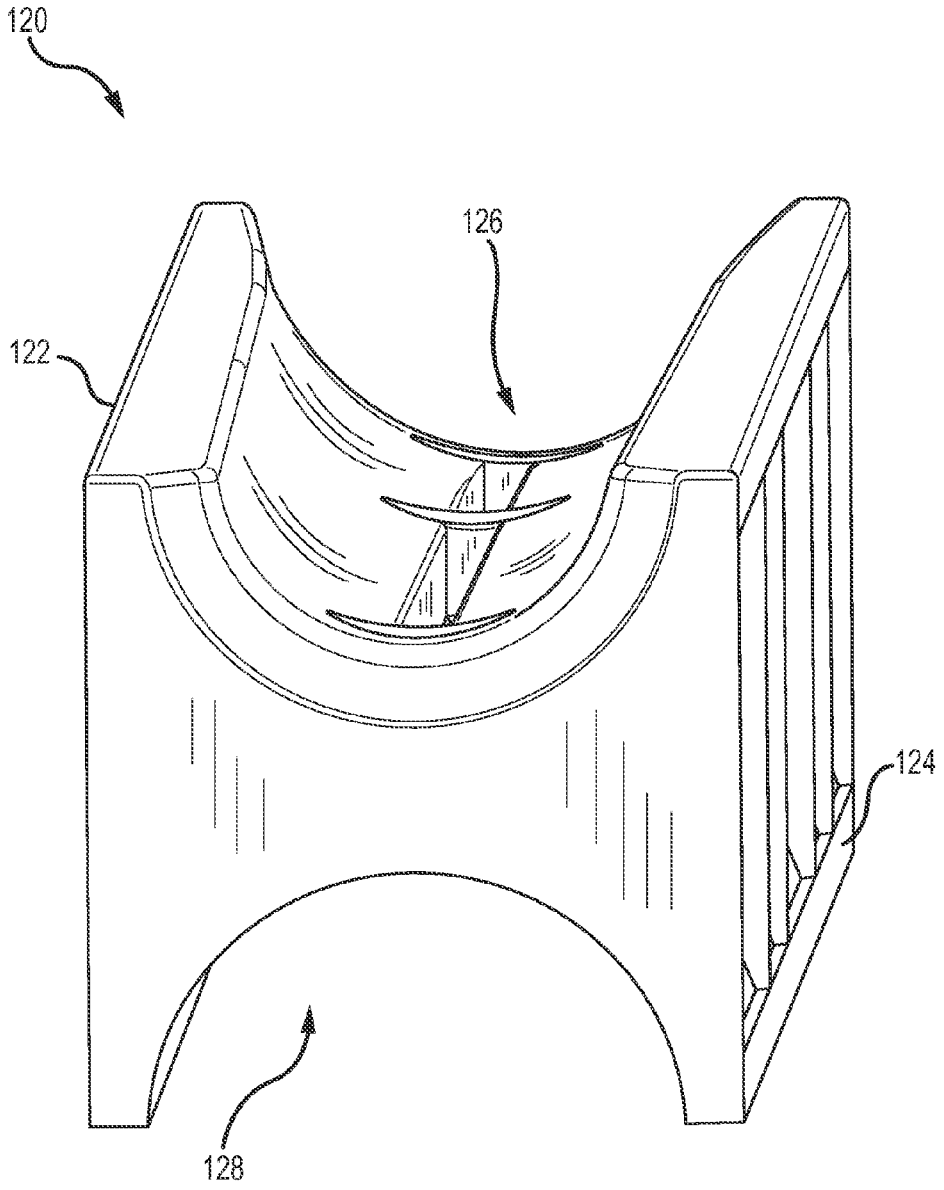
FIG. 5 shows the selectable barrel support of FIGS. 1-4.
Figure 6:
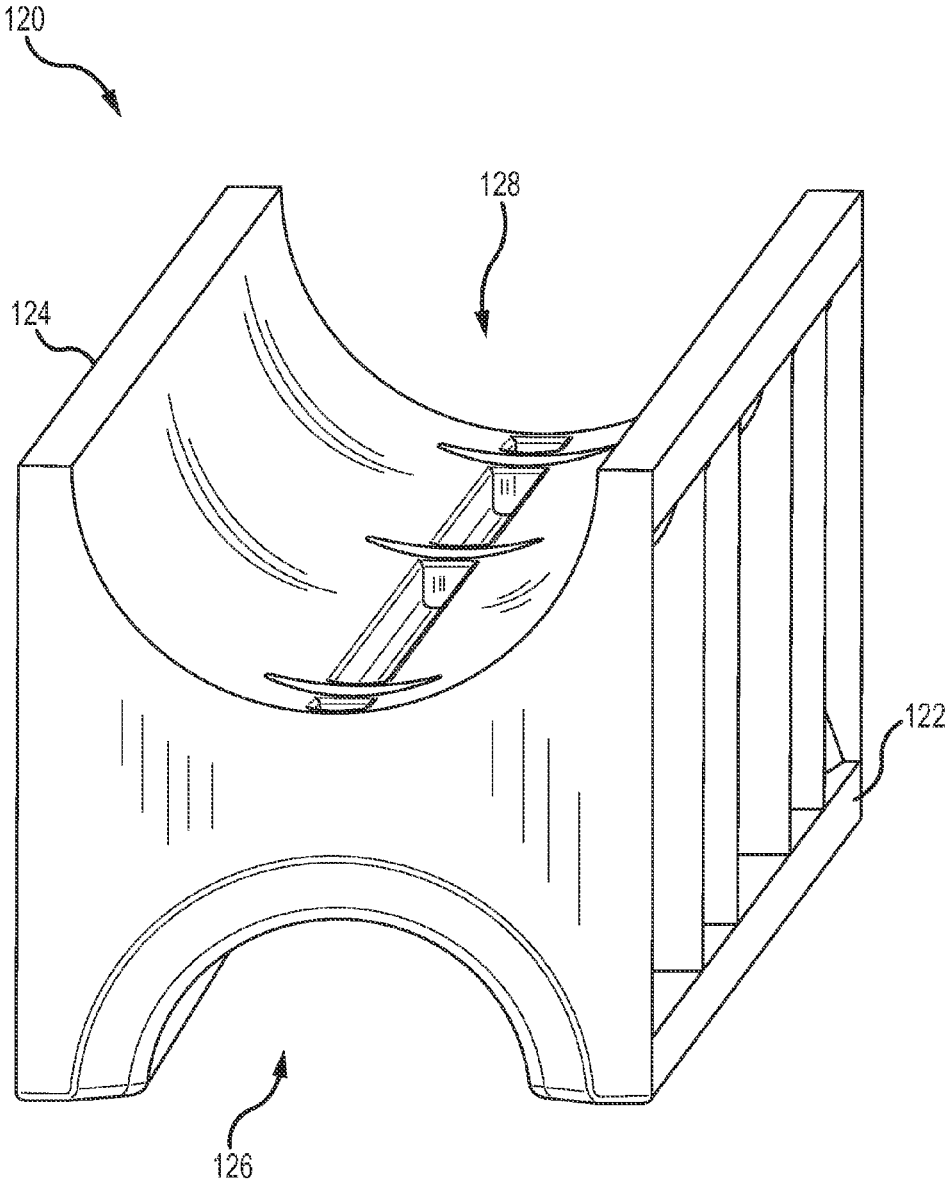
FIG. 6 shows another view of the selectable barrel support of FIGS. 1-4.
Figure 7A:
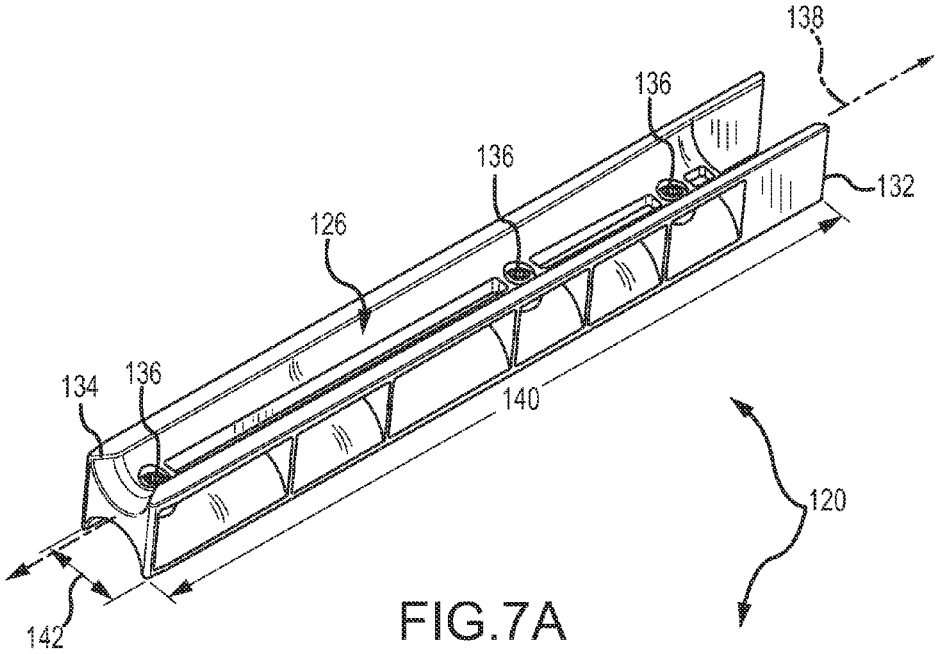
FIG. 7A shows an additional view of the selectable barrel support of FIGS. 1-4.
Figure 7B:
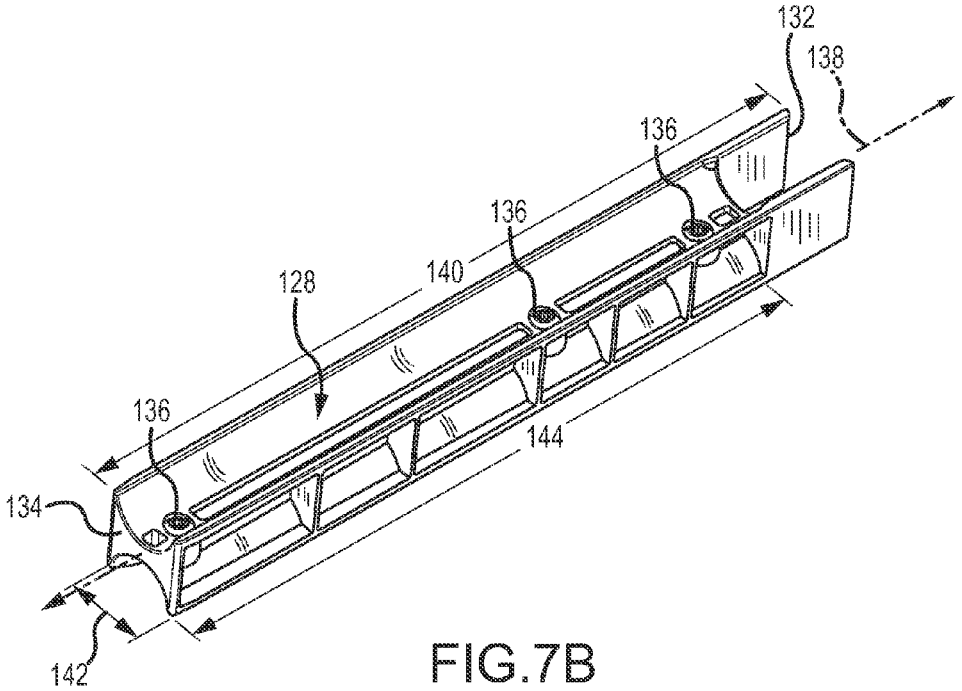
FIG. 7B shows an additional view of the selectable barrel support of FIGS. 1-4.
Figure 8:
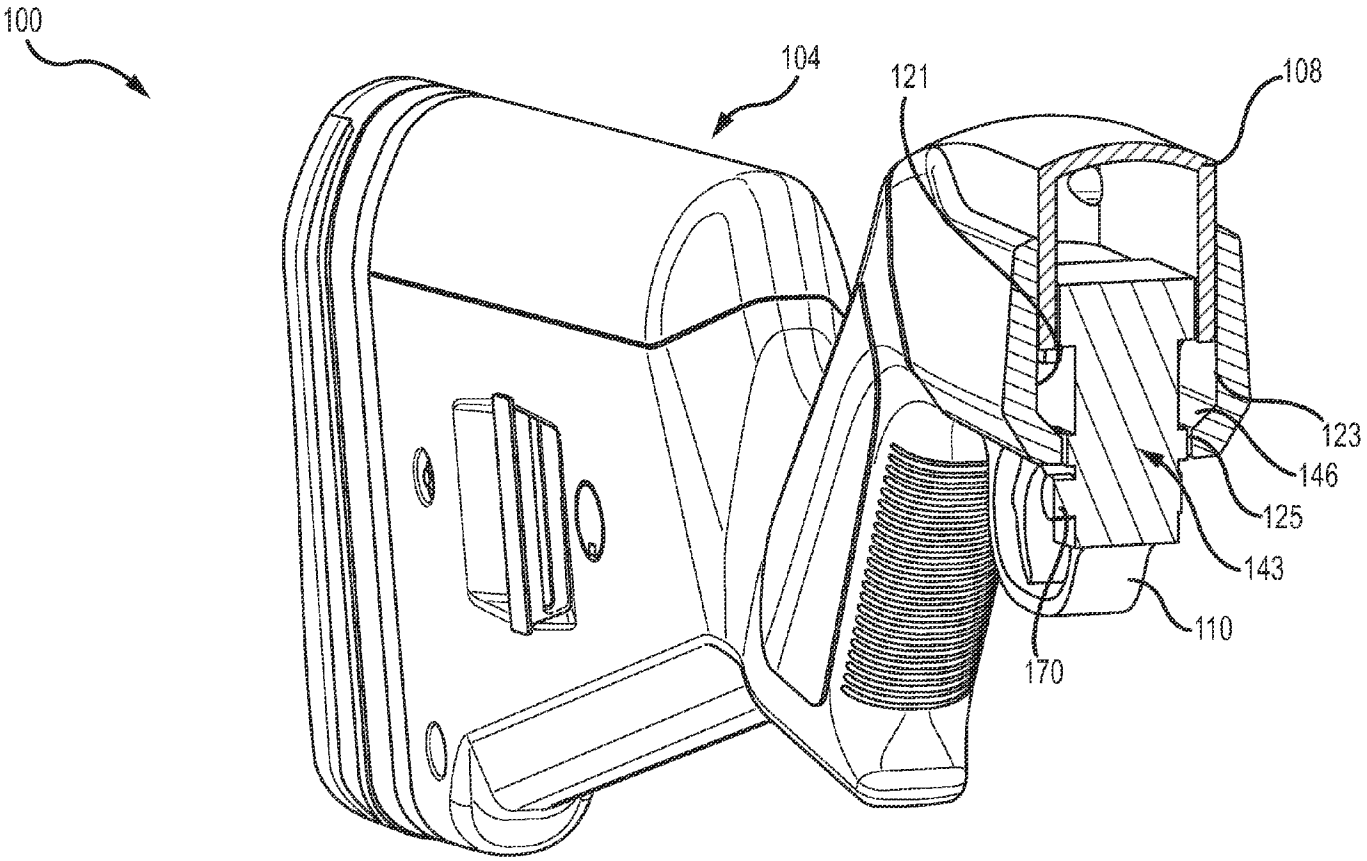
FIG. 8 shows a cross section of the trigger guard region of the firearm of FIG. 1.
Figure 9:
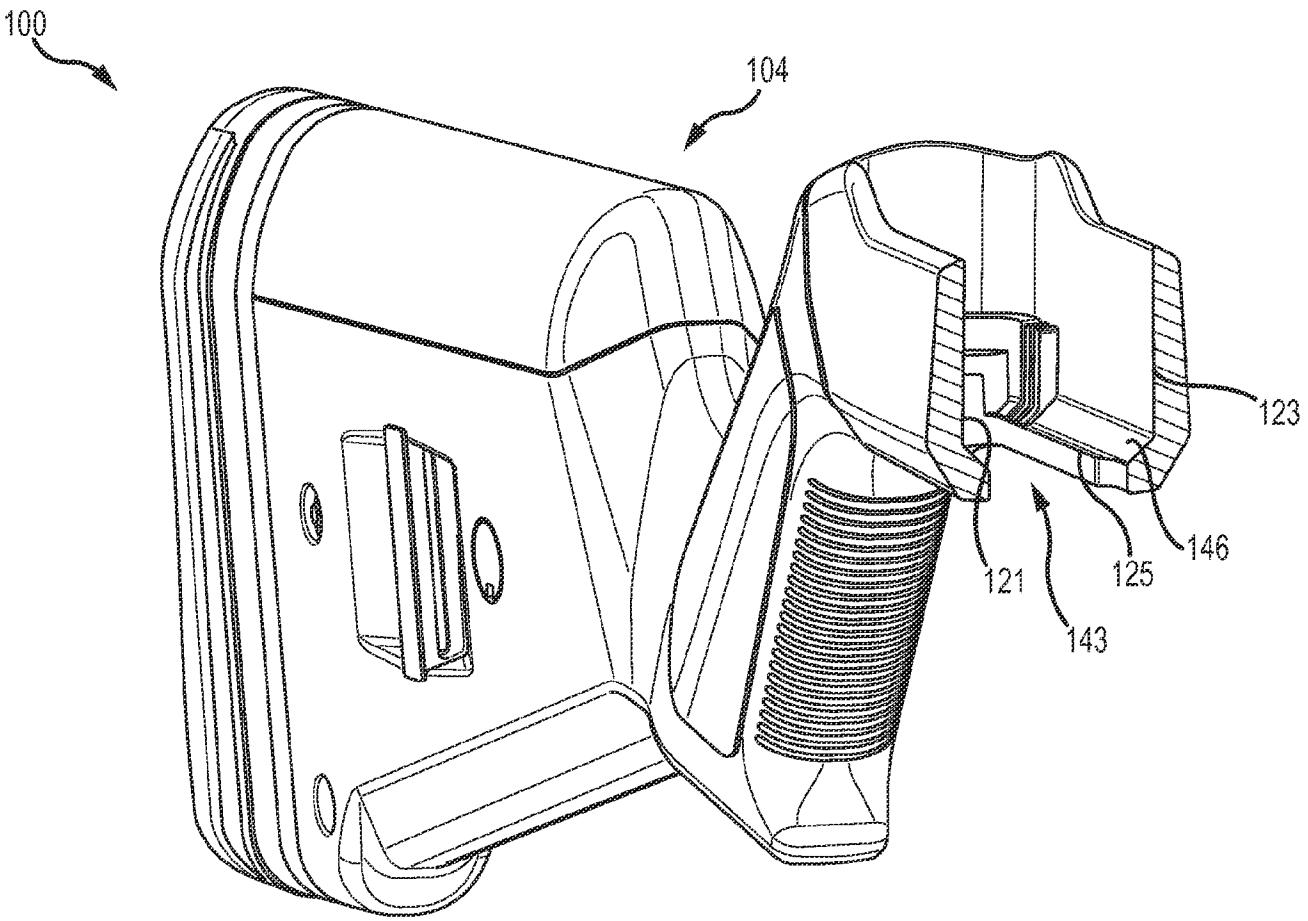
FIG. 9 shows another cross section of the trigger guard region of the firearm of FIG. 1 but without showing the action.
Figure 10:
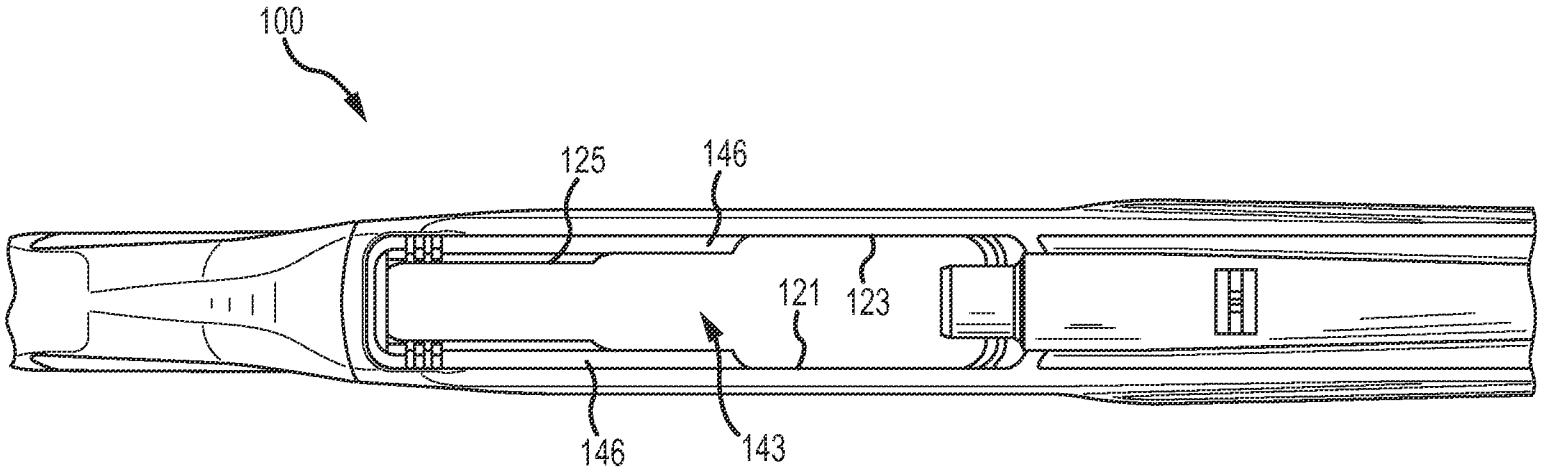
FIG. 10 shows yet another top view of the trigger guard region of the firearm of FIG. 1 but without showing the action.
Figure 11:
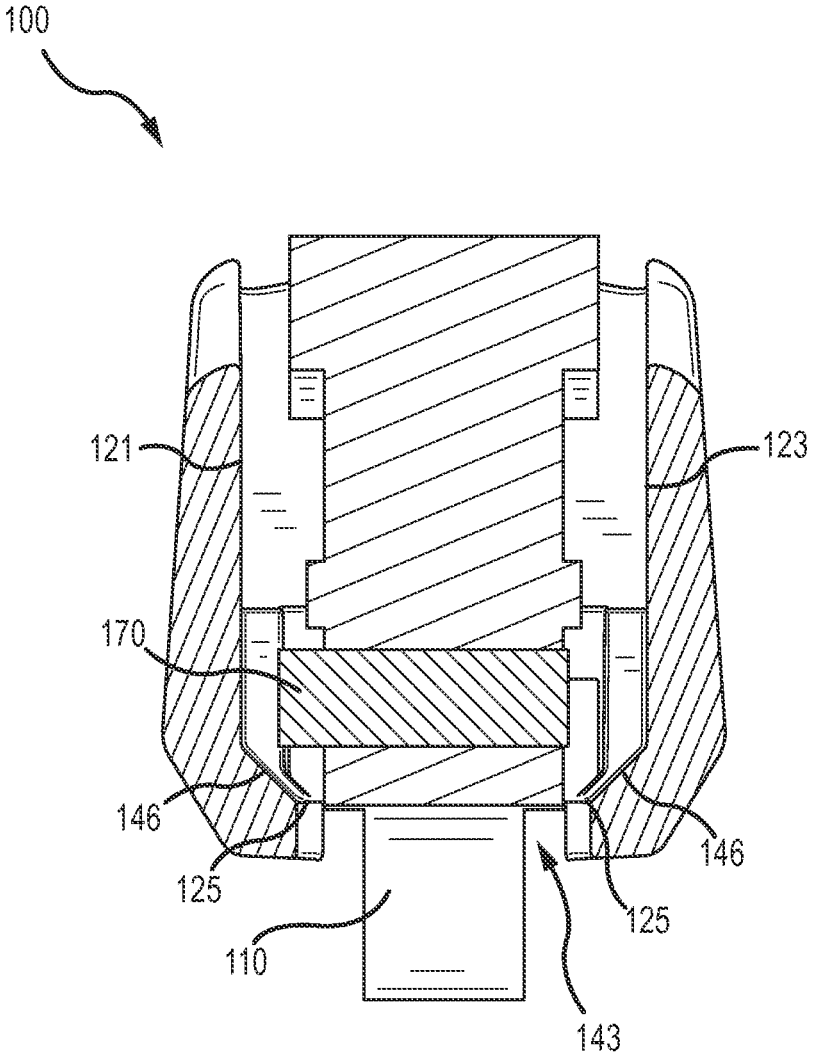
FIG. 11 shows a cross sectional view of the trigger guard region of the firearm of FIG. 1 but without showing the receiver.

The forend 102 can extend from behind the receiver 108 to a front end of the forend 114. The illustrated stock 100 is shown with a receiver 108 and a trigger assembly 110 inserted in the stock 100. The forend 102 can include a recess 116 formed from first and second inner sides 121, 123 and an inside bottom 125. The forend 102 can include a selectable barrel support 120 (see FIGS. 2-4) shaped to fit into the recess 116 in the forend 102, and can include an elongate frame having a longitudinal axis 138 (see FIGS. 7A and 7B) parallel to a longitudinal axis of the stock 100. A longitudinal dimension 140 of the selectable barrel support 120 extending from proximal a front end of the forend 114 to proximal a front end of the receiver 108 of the firearm 101 along the longitudinal axis 138 can be greater than a lateral dimension 142 of the elongate frame. The selectable barrel support 120 can include a first side 122 and a second side 124 (see FIGS. 5-6), each side 122, 124 shaped to fit a respective inner side 121, 123 of the stock 100. The shape of the first and second sides 122, 124 and the respective inner sides 121, 123 can be such that the selectable barrel support 120 releasably forms a snap, friction, or interference fit with the recess 116 in the forend 102.

The selectable barrel support 120 includes a first concave barrel recess 126 and a second concave barrel recess 128, each arranged on separate sides (e.g., opposing or adjacent sides) of the selectable barrel support 120, and each configured to support a different type of barrel when the selectable barrel support 120 is engaged in the forend 102 of the firearm stock 100. However, the selectable barrel support 120 can also be configured to support more than two different barrel types. In the illustrated embodiment, the first concave barrel recess 126 is shaped to support a tapered barrel, while the second concave barrel recess 128 is shaped to support a bull barrel or competition barrel. To do this, the first concave barrel recess 126 has radii at fore and aft portions shaped to support a first barrel type (e.g., a tapered barrel 112), and the second concave barrel support 128 has radii at fore and aft portions shaped to support a second barrel type. In particular, the firearm 101 of FIG. 1 has a tapered barrel 112, and the first concave barrel recess 126 of the selectable barrel support 120 faces upward toward the barrel 112 and supports the barrel 112. In this embodiment, the first concave barrel recess 126 has a greater radius at an aft portion 132 than at a fore portion 134. The second concave barrel recess 128 is illustrated with an equal radius at fore and aft portions 134, 132 of the first concave barrel recess 126. However, the second concave barrel recess 128 can have a radius at the fore portion 134 that is equal to or greater than a radius at the aft portion 132 (e.g., where a bull barrel or competition barrel has a reverse taper—tapering from the muzzle toward the chamber). Said another way, the radii at the fore and aft portions of the first concave barrel recess 126 can be equal and the radii at the fore and aft portions of the second concave barrel recess 128 can be unequal.

In some embodiments, the first and second concave barrel recesses 126, 128 can be configured to support barrel types other than bull or tapered barrels. For instance, one type of supported barrel can include a stepped or staggered barrel having two or more cylindrical sections, where no two adjoining sections have the same radius. Other barrel types may taper toward a middle of the barrel and then flare toward the opposing end, thus very roughly being referred to as an hourglass shape (e.g., an M16 barrel). Other barrel types may include a combination of steps as well as tapering. Some barrel types can use a stepped or staggered shape to approximate a tapered barrel (i.e., an average radius of the barrel along its length tapers). Whatever the barrel types, the first and second concave barrel recesses 126, 128 can be configured and shaped to support any one or more barrel types (e.g., bull, tapered, staggered, hourglass, etc.), such that rotating the selectable barrel support 120 allows two or more different barrel types to be installed on the firearm 101 without a change in the stock 100.

The selectable barrel support 120 has been shown and described as having two concave barrel recesses 126, 128. Yet, in other embodiments, three or more concave barrel recesses can be implemented. For instance, a selectable barrel support (or a rotatable barrel support) having three sides, and one concave barrel recess in each of those three sides, can be implemented (see, for example, FIG. 15). In such an embodiment, the forend 102 can include a recess 116 shaped like a "V", having angled ribs to support two of the three sides of the selectable barrel support, or any other structure shaped to support and/or engage with the three-sided selectable barrel support. In another embodiment, the concave barrel recess can include four sides, each having a concave barrel recess configured to support a different barrel type (see, for example, FIG. 16).

Figure 15:
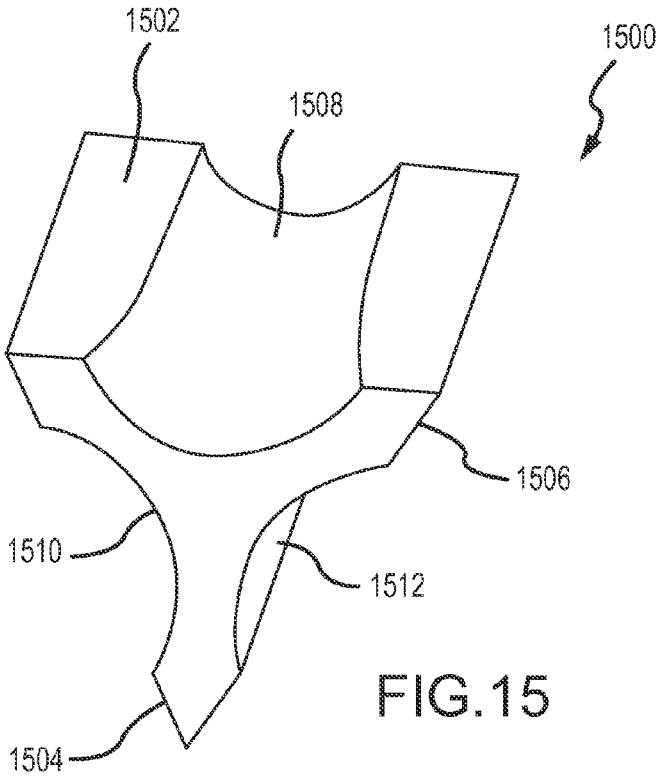
FIG. 15 shows another embodiment of a selectable barrel support.

FIG. 15 shows yet another embodiment of a selectable barrel support. The selectable barrel support 1500 includes three sides 1502, 1504, 1506 each arranged on separate (or adjacent) sides of the selectable barrel support 1500, and each configured to support a different type of barrel when the selectable barrel support 1500 is engaged in the forend of a firearm stock. At least the first concave barrel recess 1508 is illustrated as shaped to support a tapered barrel, and the figure is shown from an aft perspective such that a muzzle of a barrel supported by the tapered barrel support 1500 would be directed into the page.

Figure 16:
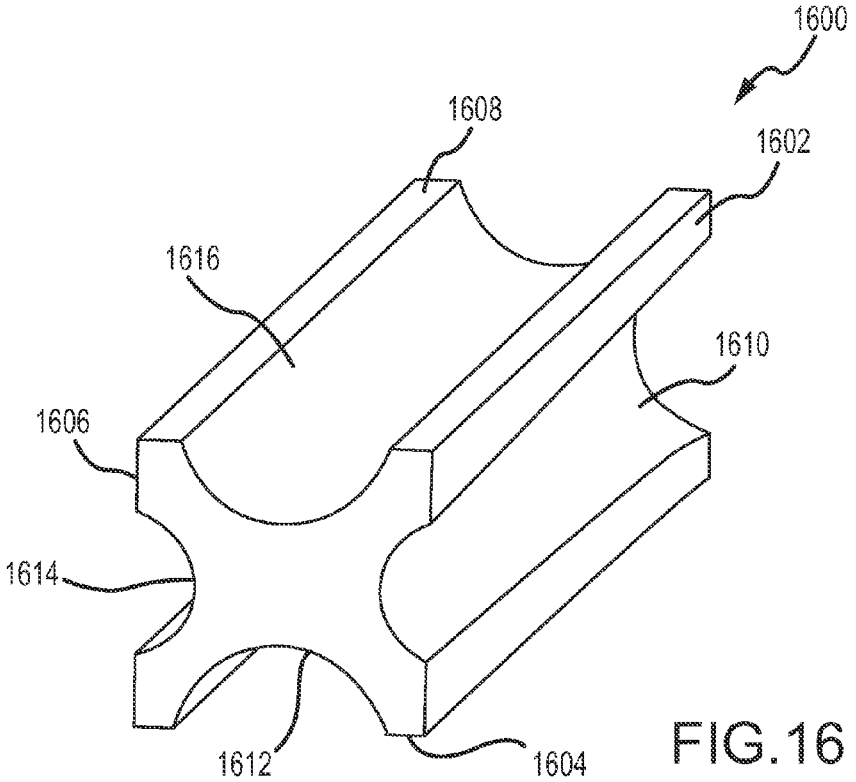
FIG. 16 shows yet another embodiment of a selectable barrel support.

FIG. 16 shows yet another embodiment of a selectable barrel support. The selectable barrel support 1600 includes four sides 1602, 1604, 1606, 1608 each arranged on separate sides of the selectable barrel support 1600, and each configured to support a different type of barrel when the selectable barrel support 1600 is engaged in the forend of a firearm stock. At least the first concave barrel recess 1610 is illustrated as shaped to support a tapered barrel, and the figure is shown from a fore perspective such that a muzzle of a barrel supported by the tapered barrel support 1600 would be directed out the page. One of the four concave barrel recesses 1610, 1612, 1614, 1616, and it's corresponding side 1602, 1604, 1606, 1608 would typically be arranged facing upward toward a barrel of a firearm, while an opposing side 1602, 1604, 1606, 1608 would face downward into the forend of the firearm. As illustrated, the fourth side 1608 and the fourth concave barrel recess 1616 face upwards towards where a barrel might reside, while the opposing side, the second side 1604, as well as its corresponding second concave barrel recess 1612, face downward. The second and fourth concave barrel recesses 1612, 1616 are shaped to support a bull barrel, while the first concave barrel recess 1610 is shaped to support a tapered barrel.

Returning to FIG. 1, the selectable barrel support 120 is inserted in the stock 100 such that the first concave barrel recess 126 is oriented upward to support a barrel 112 (e.g., a tapered barrel) while the second concave barrel recess 128 is oriented downward toward a bottom of the recess 116 of the forend 102. In this arrangement, the barrel 112 can rest in the first concave barrel recess 126 and contact the selectable barrel support 120. Similarly, when the second concave barrel recess is oriented upward toward the barrel 112, the barrel 112 can rest in the second concave barrel recess 128 and contact the selectable barrel support 120. However, the selectable barrel support 120 can also be used with free-float barrels or assemblies and in these cases, while a free-float barrel may fit partially into the first and/or second barrel recesses 126, 128, the barrel does not contact the selectable barrel support 120. In the illustrated embodiments, the first and second concave barrel recess 126, 128 have a longitudinal dimension 144 that is less than the longitudinal dimension 140 of the selectable barrel support 120.

To enable the selectable barrel support 120 to be releasably held in the forend 102 to the firearm stock 100, the selectable barrel support 120 can be shaped so as to have a snap fit, friction fit, or interference fit with the recess 116 (e.g., a snap, friction, or interference fit with one or more of the first inner side 121, the second inner side 123, and the inside bottom 125). Alternatively, and as illustrated, the selectable barrel support 120 can include one or more optional fastener apertures enabling optional fasteners 136 to be used to secure the selectable barrel support 120 to the stock 100 or to the forend 102 (these are not required as the barrel 112 can also perform the role of holding the selectable barrel support 120 to the stock 100). The illustrated embodiment includes three optional fasteners 136 with corresponding apertures in the forend 102, but this number is not limiting, and greater than or less than three can be implemented. In some cases, no fasteners are implemented. For instance, the selectable barrel support 120 may be releasably held in place via a snap, friction, or interference fit with the first and second inner sides 121, 123. The releasable hold on the selectable barrel support 120 can be aided by contact with a bottom of the barrel 112. In other instances, limited or no friction between the barrel support 120 and the forend 102 exists, and instead, contact from a bottom of the barrel 112 holds the barrel support 120 in place. Further, in some instances, a combination of fasteners, and a snap, friction, or interference fit can be implemented. While the illustrated optional fasteners 136 are round-head screws, other types of fasteners can also be used without departing from the scope and spirit of the disclosure.

In some embodiments, the firearm stock 100 can also include structure to assist a firearms user to insert the trigger assembly 110 into the stock 100 (see FIGS. 8-13). A typical safety pin 170 of the trigger assembly 110 has two stable manufacturer-intended positions: fire or safe. In both of these positions, the safety pin 170 extends laterally from the trigger assembly 110 perpendicularly to the longitudinal axis of the stock 100. For instance, in FIGS. 8, 11, and 13 the safety pin 170 extends to a left of the trigger assembly 110, which can either be a safe or fire position, depending on specifications of the firearm 101. In order to insert the trigger assembly 110 into the stock 100 or remove the trigger assembly 110 from the stock 100, the trigger assembly 110 must pass at least partially through an aperture 143 (e.g., having a substantially rectangular shape). In the safe or fire positions, the safety pin 170 typically extends beyond a perimeter of the aperture 143 (see FIG. 11), and thus the trigger assembly 110 cannot pass at least partially through the aperture 143 while the safety pin 170 is in either the safe or fire positions (e.g., either extending to the left or right of the trigger assembly 110). Therefore, a user typically 'centers' the safety pin 170 between the safe and fire positions, which is an unstable arrangement not intended by manufacturers and one not easily achieved or maintained while the trigger assembly 110 is being passed through the aperture 143.

Figure 12:
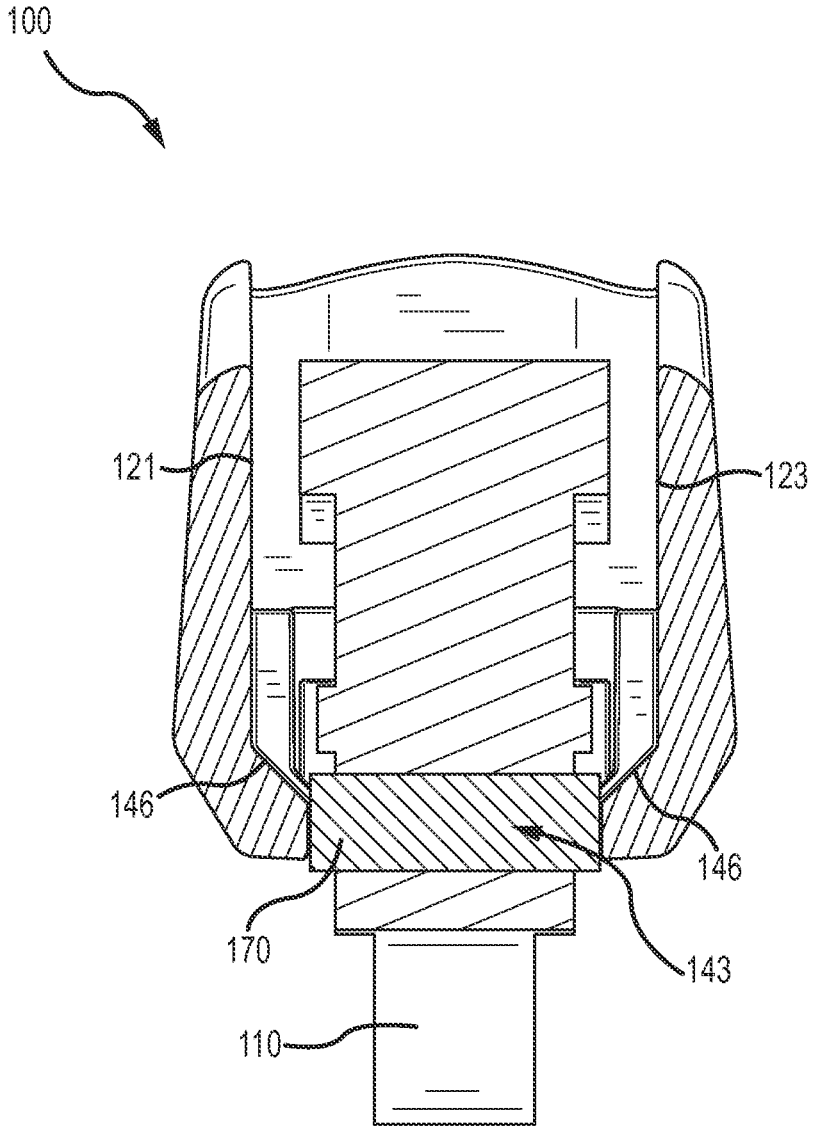
FIG. 12 shows another cross sectional view of the trigger guard region of the firearm of FIG. 1 but without showing the receiver.
Figure 13:
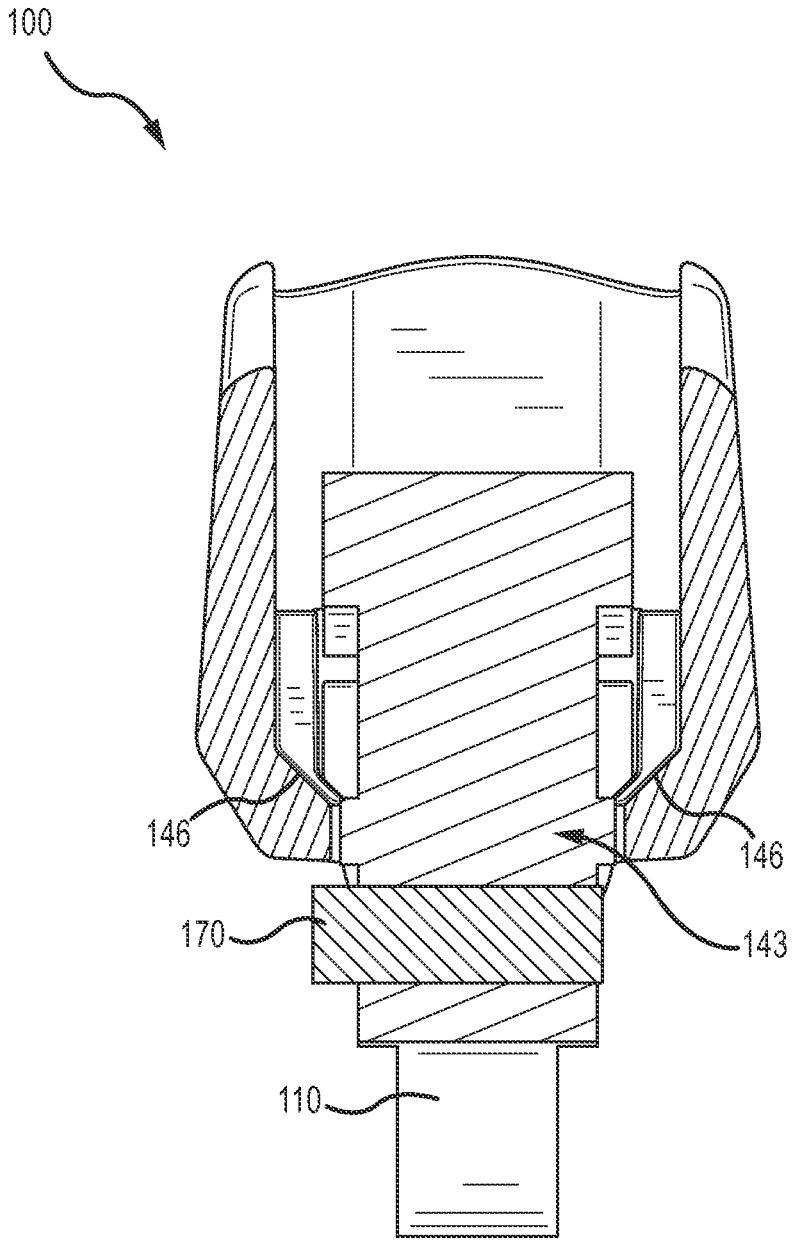
FIG. 13 shows yet another cross sectional view of the trigger guard region of the firearm of FIG. 1 but without showing the receiver.

To overcome this challenge, the herein disclosed stock 100 can include angled faces 146 that are adjacent to the first and second inner sides 121, 123 and the inside bottom 125 of the stock 100. These angled faces 146 are shaped to urge the safety pin 170 to the 'centered' position (i.e., centered across the trigger assembly 110, see for instance, FIG. 12) when the trigger assembly 110 is inserted into the stock 100 and passed at least partially through the rectangular aperture 143. Once the safety pin 170 has passed through the aperture 143, the safety pin 170 can return to the safe or fire position under the force of its own internal structure (i.e., since the 'centered' position of FIG. 12 is unstable), as shown in FIG. 13.

The stock 100 is illustrated as being configured for a RUGER 10/22 platform, other firearms platforms, including other .22 caliber firearms and firearms of different calibers, can also use the herein disclosed features.

Figure 14:
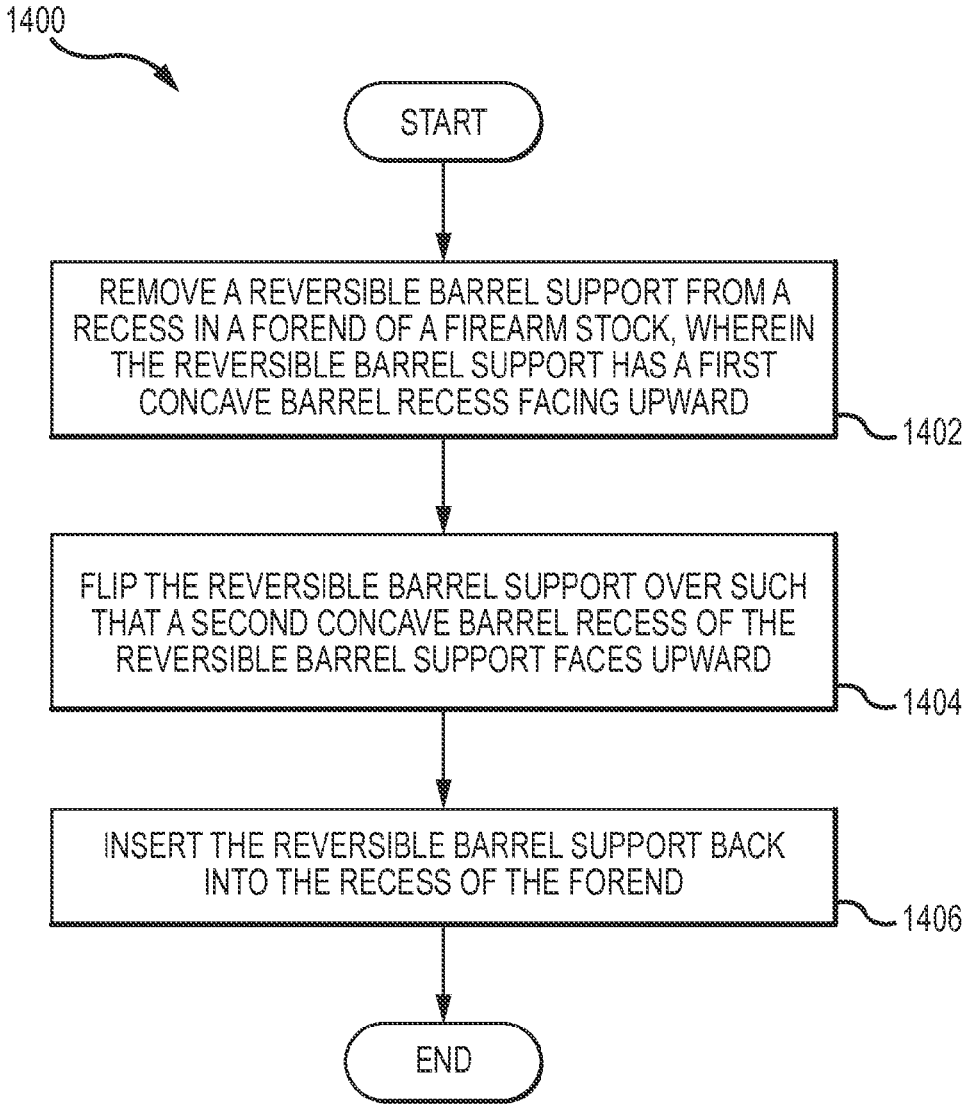
FIG. 14 shows a method of attaching a reversible barrel support to a firearm stock.

FIG. 14 illustrates a method of attaching a selectable (or reversible) barrel support to a firearm stock. The method 1400 includes removing a reversible barrel support from a recess in a forend of a firearm stock, wherein the reversible barrel support has a first concave barrel recess facing upward (Block 1402). For the purposes of this disclosure, upward can reference a vector starting at a bottom of a forend and traversing toward a barrel of the firearm. In an embodiment, this reversible barrel support can be shaped to fit two different barrel types, for instance a bull or competition barrel, and a tapered barrel tapering from the chamber toward the muzzle. The first concave barrel recess can be shaped to support a first barrel type, and a second concave barrel recess can be shaped to support a second barrel type. Where either or both barrel types are floating, the term "support" may not include physical contact between the reversible barrel support and the one or more floating barrels. The reversible barrel support may be releasably held in place via a snap, friction, or interference fit with first and second inner sides of the forend. This releasable hold on the reversible barrel support can be aided by contact with a bottom of the barrel. In other instances, limited or no friction between the barrel support and the forend exists, and instead, contact from a bottom of the barrel holds the barrel support in place. The method 1400 further includes flipping the reversible barrel support over such that a second concave barrel recess of the reversible barrel support faces upward (Block 1404), and inserting the reversible barrel support back into the recess in the forend (Block 1406). The method 1400 can be reversed and can be repeated as many times as desired. Further, the method 1400 can be implemented when switching between any two different types of barrels.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein. Those skilled in the art can readily recognize that numerous variations and substitutions may be made in the invention, its use and its configuration to achieve substantially the same results as achieved by the embodiments described herein. Accordingly, there is no intention to limit the invention to the disclosed exemplary forms. Many variations, modifications and alternative constructions fall within the scope and spirit of the disclosed invention as expressed in the claims.

What is claimed is:

1. A firearm stock comprising:

a forend comprising a recess formed from first and second inner sides of the forend and an inside bottom of the forend;

a buttstock coupled to the forend; and a selectable barrel support comprising:

an elongate frame having a longitudinal dimension configured to be parallel to a longitudinal axis of the forend;

first and second sides shaped to interface with the first and second inner sides of the forend;

a first concave barrel recess having a radius at a fore portion of the concave barrel recess that is equal to or greater than a radius at an aft portion of the concave barrel recess; and a second concave barrel recess having a greater radius at an aft portion of the second concave barrel recess than at a fore portion of the second concave barrel recess, wherein the first and second concave barrel recesses are on opposite sides of the elongate frame, one of the first and second concave barrel recesses configured to face upward toward a bottom of a barrel of the firearm when the selectable barrel support is engaged in the forend of the firearm stock.

2. The selectable barrel support of claim 1, wherein the selectable barrel support has a longitudinal dimension such that the selectable barrel support, when engaged with the forend, is configured to extend from a receiver to a front end of the forend.

3. The selectable barrel support of claim 1, wherein the selectable barrel support is configured to support a free-floating barrel and to not contact the barrel of the firearm.

4. The selectable barrel support of claim 1, wherein the selectable barrel support is configured to contact and support the barrel of the firearm.

5. The selectable barrel support of claim 1, wherein the selectable barrel support is releasably held in the forend of the firearm stock by at least means other than fasteners.

6. The selectable barrel support of claim 5, wherein the selectable barrel support is releasably held in the forend of the firearm stock by at least a snap fit, friction fit, or interference fit.

7. The selectable barrel support of claim 1, wherein the selectable barrel support is releasably held in the forend of the firearm stock by one or more fasteners.

8. The selectable barrel support of claim 1, configured to receive either a bull barrel or a barrel tapered toward a front of the barrel without requiring a change of the firearm stock.

9. The selectable barrel support of claim 1, wherein at least one of the first and second concave barrel recesses has a longitudinal dimension that is less than a longitudinal dimension of the selectable barrel support.

10. The firearm stock of claim 9, wherein the forend and the buttstock are modular and therefore different forends and buttstocks are interchangeable.

11. The firearm stock of claim 10, further comprising a modular grip section coupled between the forend and the buttstock.

12. A selectable barrel support of a firearm stock, the selectable barrel support, comprising:

an elongate frame having a longitudinal axis configured to be parallel to a longitudinal axis of the firearm stock, the elongate frame having a greater longitudinal dimension than a lateral dimension;

a first concave barrel recess having radii at fore and aft portions of the first concave barrel recess shaped to support a first barrel type; and a second concave barrel recess having radii at fore and aft portions of the second concave barrel recess shaped to support a second barrel type, wherein the first and second concave barrel recesses are arranged on two separate sides of the elongate frame, one of the first and second concave barrel recesses configured to face upward toward a bottom of a barrel of the firearm when the selectable barrel support is engaged in the forend of the firearm stock.

13. The selectable barrel support of claim 12, wherein the selectable barrel support has a longitudinal dimension that extends from proximal a front edge of the forend to proximal a front end of a receiver of the firearm.

14. The selectable barrel support of claim 12, wherein the selectable barrel support is configured to support a free-floating barrel and to not contact the firearm barrel.

15. The selectable barrel support of claim 12, wherein the selectable barrel support is configured to contact and support a barrel of the firearm.

16. The selectable barrel support of claim 12, wherein the selectable barrel support is configured to be held in the forend of the firearm stock by at least means other than fasteners.

17. The selectable barrel support of claim 16, wherein the selectable barrel support is configured to be held in the forend of the firearm stock by at least a snap fit, friction fit, or interference fit.

18. The selectable barrel support of claim 12, wherein the selectable barrel support is configured to be held in the forend of the firearm stock by one or more fasteners.

19. The selectable barrel support of claim 12, configured to receive either a bull barrel or a barrel tapered toward a front of the barrel, without requiring a change of the firearm stock.

20. The selectable barrel support of claim 12, wherein at least one of the first and second concave barrel recesses has a longitudinal dimension that is less than a longitudinal dimension of the selectable barrel support.

21. The selectable barrel support of claim 12, wherein the first barrel type is a bull barrel and the second barrel type is a tapered barrel.

22. The selectable barrel support of claim 12, where the radii at the fore and aft portions of the first concave barrel recess are equal, and the radii at the fore and aft portions of the second concave barrel recess are not equal.

23. The selectable barrel support of claim 12, further comprising first and second sides shaped to interface with inner sides of a forend of the firearm stock.

24. The selectable barrel support of claim 12, further comprising a third concave barrel recess shaped to support a third barrel type.

25. The selectable barrel support of claim 23, further comprising a fourth concave barrel recess shaped to support a fourth barrel type.

26. A method of attaching a reversible barrel support to a firearm stock, the method comprising:

removing a reversible barrel support from a recess in a forend of a firearm stock, wherein the reversible barrel support has a first concave barrel recess facing upward;

rotating the reversible barrel support such that a second concave barrel recess of the reversible barrel support faces upward; and inserting the reversible barrel support back into the recess in the forend.

27. The method of claim 26, further comprising securing the reversible barrel support to the forend with at least one fastener.

28. The method of claim 26, further comprising securing the reversible barrel support to the forend with at least a snap fit, friction fit, or interference fit.

29. The method of claim 26, further comprising securing the reversible barrel support to the forend via at least contact with a bottom of a firearm barrel.

30. The method of claim 26, further comprising removing the reversible barrel support from the recess in the forend of the firearm stock, wherein the reversible barrel support has the second concave barrel recess facing upward; and rotating the reversible barrel support such that a third concave barrel recess of the reversible barrel support faces upward.

* * * * *